United States Patent [19]

FitzPatrick

[11] Patent Number: 4,882,217

[45] Date of Patent: Nov. 21, 1989

[54] NEEDLED PRESS FELT

[75] Inventor: Keith FitzPatrick, Dieren, Netherlands

[73] Assignee: Albany International Corp., Menands, N.Y.

[21] Appl. No.: 269,248

[22] Filed: Nov. 9, 1988

[51] Int. Cl.[4] ..... B32B 7/02

[52] U.S. Cl. ..... 428/212; 428/280; 428/288; 428/297; 428/300; 428/903

[58] Field of Search ..... 428/212, 213, 280, 286, 428/287, 297, 298, 300, 903, 288

[56] References Cited

U.S. PATENT DOCUMENTS 3,392,079 7/1968 Fekete ..... 428/227

3,928,699 12/1975 Fekete ..... 428/212

4,482,601 11/1984 Hartigan ..... 428/300

*Primary Examiner*—James J. Bell

*Attorney, Agent, or Firm*—Kane, Dalsimer, Sullivan, Kurucz, Levy, Eisele & Richard

[57] ABSTRACT

A needled press felt, i.e. a felt which is intended to be used in the press section of a papermaking machine. The batt part of the felt comprises at least two kinds of fiber one of which consists of fibers having a diameter size 0.010 mm or less. These fibers are removed either successively or intermittently during the service of the felt in the press section, whereas the rest of the fibers in the batt part of the felt, i.e. the fibers having a larger diameter than those of the first kind, remain in the batt part.

6 Claims, No Drawings

NEEDLED PRESS FELT

BACKGROUND OF THE INVENTION

1. Field of the Invention

The subject invention concerns a needled press felt which is designed for use in the press section of a papermaking machine. The batt part of the felt comprises at least two different kinds of fibers, of which a first kind of fiber is of a considerably finer-diameter size than the other kinds of fibers. The batt part may be needled into a base fabric.

2. Brief Description of the Prior Art

A papermaking machine comprises three different sections, viz. the forming section, the press section and the dryer section. In the forming section the stock suspension is discharged onto a forming fabric or between two forming fabrics. Most of the water contained in the stock suspension is removed by gravity drainage or by suction, passing through the forming fabric, whereby a continuous paper sheet is formed. The formed sheet is carried to the press section and in this section more water is removed from the fibrous web when the latter is squeezed between press rollers. Finally, the sheet is dried in the dryer section by being applied against heated cylinders, the moisture being removed through evaporation.

From a dewatering point of view the most important section is the press section. Economically, it is considerably more advantageous to remove the water by using squeezing methods than to drive it off by using heat. For this reason, one aims at achieving a fibrous web having maximum dry contents when leaving the press section in order to reduce the energy consumption in the drier section.

In the press section of the papermaking machine the paper web is made to travel together with one or several press felts through a number of press nips. In the press nips, water is squeezed from the paper web and into or through the press felt. Normally, the press felt structure contains one soft and comparatively compressible surface layer. Underneath the surface layer is positioned another layer of a more incompressible nature, which layer is designed to retain most of its volume, also when the felt is exposed to compressive pressure. This part of the felt serves the purpose of absorbing an optimum amount of water from the paper web when the web and the felt are compressed in the press nip, of retaining an optimum amount of the squeezed-out water following the press nip and of carrying the squeezed-out water away from the press nip and discharging it before the felt is reintroduced into the press-nip.

Immediately following the press nip, when the felt and the paper web expand, the risk of rewetting of the paper web is considerable. To counteract such rewetting risks the surface layer of the felt preferably should contain as fine-dimension fibers as possible, whereby the pore size of the layer is minimized. As a result, the higher adhesive properties of the finer-dimension capillaries improve the waterretainment ability of the felt.

The surface structure of the paper is considered largely to depend on the nature of the pressing operation and therefore dependent on the surface evenness of the press felt. The pressure distribution felt/paper web is considered to be decisive in determining the paper quality and the dewatering results. The side of the press felt which faces the paper web therefore must be as even as possible and contain as fine-dimension pores as possible. This aspect, too, speaks in favour of using fine-dimension fibers in the surface layer.

U.S. Pat. No. 3,392,079 proposes the possibility of needling a finer-fiber layer onto the surface which is intended to abut against the paper web. U.S. Pat. No. 3,928,699 describes a felt for a papermaking machine, which felt comprises two fibrous layers of which the layer intended to face the paper web contains fibers which predominantly have a diameter size of 0.027 mm or less, whereas an underlying layer contains fibers having a diameter which is at least 1.75 times larger than that of the fibers of the surface layer. In accordance with one embodiment shown in this publication, fibers of a fineness of 0.012 mm have been used for the surface layer. Thus, it is previously known to use a press felt comprising at least two layers of fibers having different fineness of which the layer facing the paper web contains finer-dimension fibers than the layer below.

Among experts in the field the importance of the running-in period of press felts is generally recognized. The running-in period is the period immediately following the mounting of a new press felt on the papermaking machine and this period may last from a couple of hours of operation up to several weeks. During this period it often becomes necessary to lower the speed of production and several other types of operational problems may occur. During the running-in period the felt, when passing through the press nip, is permanently compressed, and this permanent compression is at its highest when the machine is started up but it is reduced successively, as the felt is being compressed. During the running-in period the pores of the felts become clogged by fibers and fillers emanating from the paper sheet.

In addition, when the felt is used, its surface structure gradually becomes more even and consequently the running-in of the felt attributes to improving the paper quality. Attempts have been made to simulate the course of events of the running-in period during the manufacture of the felt and to deliver felts which already when leaving the manufacturing plant possess the qualities which the felt normally exhibits only after the running-in period.

However, this has proved to be difficult. Pre-compression effected during the manufacture affects only to a limited degree the extent of compression of the felt. Probably this is due to an existing interaction between compression and clogging which cannot be imitated outside the papermaking machine.

U.S. Pat. No. 4,482,601 describes a method of mixing a temporary material into a textile batt which is then incorporated into the felt structure. After strong pre-compression to reduce the volume of the felt and to increase the density thereof the temporary material is removed in order to form voids in the felt and give the felt a sufficient degree of openness. This technique has proved not to be useful in practice, probably because the voids which are formed during the running-in period are permanently compressed and clogged by material emanating from the paper suspension.

Although it is possible to design the felt in such a manner that it will have optimum usefulness at the start-up the permanent compression and clogging will, however, produce a felt which exhibits such a degree of impermeability that operational problems of a practical nature will arise. For instance, the web cannot be removed very easily from an impermeable felt after the press nip. Another problem encountered with felts of reduced permeability is one that is connected with the air currents ahead of the press nip. The air which enters between the felt and the web, when these two elements are brought into contact with each other, must be removed and in case this air cannot be removed through the felt because the latter is too dense the paper web tends to wrinkle or break. A felt which is designed for optimum operation already from the start therefore as a rule must be replaced prematurely after having been in operation for a short time only because of insufficient permeability and consequently the felt economy will be unsatisfactory.

Instead, prior-art solutions comprise designing felts having coarser surface fibers than what is desirable for the purpose of allowing permanent compression and clogging during the running-in period and still retain sufficient permeability for the continued operation of the felt.

SUMMARY OF THE INVENTION

The invention comprises a needled press felt for use in the press section of a papermaking machine, which comprises;

at least a first and a second kinds of fiber in the batt part of the felt, said first kind of fiber constituting at least part of the surface layer, which in position of use of said press felt, facing the paper web, is of considerably finer dimension than the other kinds of fibers and having a diameter of 0.010 mm or less and have low resistance to being essentially removed during the service of the felt of the papermaking machine, said other kinds of fiber are essentially resistant during the removal of the first kind of fiber.

The removal of the first kind of fiber may be effected successively or periodically. The first kind of fibre may be fibers which are less abrasion resistant fibers and are successively worn off from the surface layer of the batt part or else the first kind of fiber may be fibers which could be dissolved in suitable chemicals, causing these fibers to degrade. In certain machine constructions, the press felt travels in abutment against a hot cylinder. Machine constructions also exist wherein the felt passes across steam chests. In felts intended for such machine constructions, the first kind of fiber preferably are fibers which are degraded by heat whereas the rest of the fibers essentially are thermal-resistant fibers.

The subject invention has for its purpose to eliminate the operational problems in the press felts during their running-in period and to provide a felt having optimum efficiency during its entire serviceable life. Because the surface layer of the felt consists at least partly of fibers having a diameter of 0.010 mm or less, this surface layer will form a system of very minute pores. The permeability thus is adjusted to ensure that optimum operation efficiency exists already at the start-up. The minute pores retain water inside the felt without causing rewetting in conjunction with the expansion which occurs following the press nip. At the same time the extremely fine fibers result in a felt surface which provides for optimum distribution of the pressure against the paper web and thus improved paper quality and improved dewatering effects already from the start.

If a felt according to prior-art techniques were to be used it would, when exposed repeatedly to compression, become permanently compressed. In addition, the slurry in the form of fibers and fillers would clog the very minute pores and cause such a reduction of the permeability that the felt could no longer be used but would have to be replaced after having been in operation for only a very brief period.

In addition to being an extremely fine-diameter fiber the first kind of fiber has been chosen to ensure that it will disappear continuously or discontinuously through abrasion or degradation. The unevitable effects of permanent compression and clogging are compensated for by these fiber losses, and during its entire running-in period the felt will achieve a useful permeability balance.

The felt may function with optimum results form the start and it reaches its normal degree of compression and clogging without reduction of the permeability because of the simultaneous removal of fibers form the batt with resulting opening-up of the felt.

According to the prior art, the fiber material in a press felt usually consist of polyamide fibers which are capable of resisting the abrasion occurring upon the repeated passages through the press nip. Tests have shown that if e.g. polyester fibers are used in the surface layer, these fibers will wear out within a very short time. For this reason, these fibers are very suitable for use as the first kind of fiber in accordance with the invention.

What is claimed is:

1. A needled press felt for use in the press section of a papermaking machine, which comprises;

at least a first and a second kind of fiber in the batt part of the felt, said first kind of fiber constituting at least part of the surface layer, which in position of use of said press felt, facing the paper web, is of considerably finer dimension than the other kinds of fiber and having a diameter of 0.010 mm or less and have low resistance to being essentially removed during the service of the felt of the papermaking machine, said other kinds of fiber are essentially resistant during the removal of the first kind of fibers.

2. The needled press felt of claim 1, wherein the fibers of the first kind are of a material ensuring that the fibers are removed successively.

3. The needled press felt of claim 1, wherein the fibers of the first kind are of a material ensuring that the fibers are removed periodically.

4. The needled press felt of claim 1, wherein the first kind of fiber is less abrasion resistant than the rest of the fibers and is arranged to be worn off successively during the use of the felt.

5. The needled press felt of claim 1, wherein the first kind of fiber is a chemically degradable fiber and is arranged to be degraded at least successively whereas the rest of the fibers essentially are resistant to the chemical.

6. The needled press felt of claim 1, wherein the first kind of fiber is heat-degradable whereas the rest of the fibers essentially are heat resistant.

* * * * *